US008707667B2

(12) United States Patent
Heinen et al.

(10) Patent No.: US 8,707,667 B2
(45) Date of Patent: Apr. 29, 2014

(54) TEXTILE MACHINE WITH A PLURALITY OF WORKSTATIONS

(75) Inventors: Georg Heinen, Krefeld (DE); Jurgen Schnitzler, Viersen (DE); Jorg Zischewski, Willich (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/593,864

(22) Filed: Aug. 24, 2012

(65) Prior Publication Data

US 2013/0219849 A1 Aug. 29, 2013

(30) Foreign Application Priority Data

Aug. 26, 2011 (DE) ..... 10 2011 111 725

(51) Int. Cl.
*D01H 13/00* (2006.01)

(52) U.S. Cl.
USPC ..... 57/104

(58) Field of Classification Search
USPC ..... 57/92, 104, 105
See application file for complete search history.

(56) References Cited

U.S. PATENT DOCUMENTS

| | | | | | |
|---|---|---|---|---|---|
| 318,405 | A | * | 5/1885 | Whitin | 57/104 |
| 380,784 | A | * | 4/1888 | Binns | 57/104 |
| 3,152,434 | A | * | 10/1964 | Kemmler | 57/105 |
| 3,391,527 | A | * | 7/1968 | Kato | 57/313 |
| 4,370,852 | A | * | 2/1983 | Oberstrass et al. | 57/340 |
| 4,383,402 | A | * | 5/1983 | Costales et al. | 57/105 |
| 4,385,487 | A | * | 5/1983 | Costales et al. | 57/105 |
| 4,545,192 | A | * | 10/1985 | Oberstrass | 57/105 |
| 4,566,265 | A | * | 1/1986 | Naylor | 57/336 |
| 4,698,959 | A | * | 10/1987 | Schippers et al. | 57/336 |
| 4,709,543 | A | | 12/1987 | Lorenz | |
| 5,765,354 | A | * | 6/1998 | Fink et al. | 57/104 |
| 7,866,589 | B2 | | 1/2011 | Fink et al. | |
| 2002/0033012 | A1 | | 3/2002 | Kamp | |

FOREIGN PATENT DOCUMENTS

| | | | |
|---|---|---|---|
| CH | 12150 | | 5/1896 |
| CH | 34652 | | 9/1905 |
| DE | 2442340 | A1 | 3/1976 |
| DE | 3403144 | A1 | 1/1984 |
| DE | 4217360 | A1 | 12/1993 |
| DE | 10045909 | A1 | 4/2002 |
| DE | 102005050074 | A1 | 4/2007 |
| GB | 1480691 | A | 7/1977 |

* cited by examiner

*Primary Examiner* — Shaun R Hurley
(74) *Attorney, Agent, or Firm* — K&L Gates LLP

(57) ABSTRACT

A textile machine with multiple workstations equipped with a yarn processing device, and a drive shaft extending along multiple workstations, each yarn processing device connected to the drive shaft by a continuous traction means, and the drive shaft including multiple drive devices each guiding a continuous traction means. Each drive device has two grooves coaxially to the drive shaft, one of the grooves being part of a free wheel about the drive shaft. An output means is connected to each yarn processing device, each output means having front and rear guide grooves, the front groove at a free end of the output means and the rear groove adjacent the associated yarn processing device. Each traction means has one loop engaged in the rear groove of the associated output means and another loop engaged in the front groove through 180 degrees.

15 Claims, 6 Drawing Sheets

TEXTILE MACHINE WITH A PLURALITY OF WORKSTATIONS

CROSS-REFERENCE TO RELATED APPLICATION

This application claims the benefit of priority from German Patent Application No. 10 2011 111 725.7, filed Aug. 26, 2011, herein fully incorporated by reference.

FIELD OF THE INVENTION

The present invention relates to textile machines with a plurality of workstations and, more particularly, to textile machines with a large number of workstations each equipped with at least one yarn processing device.

BACKGROUND OF THE INVENTION

In textile machinery manufacturing, textile machines having a large number of identical workstations have been known for a long time in various embodiments and described in relative detail in numerous patent specifications.

Textile machines of this type, frequently also known, as multiple station textile machines are, for example, rotor spinning machines, texturing machines, flyers, ring spinning machines, two-for-one twisting machines or cabling machines, etc. Multiple station textile machines of this type often have at least one generally continuous drive shaft running in the longitudinal direction of the textile machine, to which yarn processing devices, which are, for example, overhung, are connected.

Two-for-one twisting or cabling machines, for example, have a large number of identically configured workstations of this type, which are arranged next to one another on both sides of the machine longitudinal axis and are, in each case, inter alia equipped with a winding mechanism to produce a cross-wound bobbin. The winding mechanism, in this case, generally has a friction roller for the frictional drive of a cross-wound bobbin and a yarn processing device connected upstream of the friction roller in the yarn course in the form of a so-called overfeed roller, by means of which the yarn tension of the yarn running onto the cross-wound bobbin is adjusted, in other words is generally reduced.

The order of magnitude of the reduction of the yarn tension is determined here by the wrap angle of the yarn around the overfeed roller and by the peripheral speed of the overfeed roller in relation to the winding speed of the cross-wound bobbin. In practice, this means that the cross-wound bobbin driven by the friction roller rotates at a significantly lower peripheral speed than the overfeed roller.

With regard to the drive of the friction rollers and the overfeed rollers, various embodiments are prior art in conjunction with two-for-one twisting machines or cabling machines of this type.

Two-for-one twisting or cabling machines, in which both the friction rollers and the overfeed rollers of a textile machine side are in each case driven by separate drive shafts along the length of the machine, are known, for example, from German Patent Publications DE 34 03 144 A1, DE 42 17 360 C2 or DE 100 45 909 A1. With these known two-for-one twisting or cabling machines, in particular the drive shafts for the overfeed rollers along the length of the machine and located in the working region of the operator have proven not to be very advantageous both from a safety and from an operating point of view. In other words, drive shafts of this type along the length of the machine are generally, as shown in German Patent Publication DE 100 45 909 A1, for example, provided with a casing or a covering to prevent accidents, the casing only being equipped with narrow slots at the workstations. However, with drive shafts of this type along the length of the machine, in the event of an interruption of the yarn travel, for example caused by the tearing of the yarn while being wound onto the bobbin, the problem often occurs that the yarn is picked up by the drive shaft, which continues to rotate, and is wound thereon. The operator then often tends to uncover the drive shaft or the overfeed roller by removing the covering in order to thus improve the accessibility to the wound lap produced.

A procedure of this type is, however, extremely dangerous as the drive shaft continues to revolve with an unreduced speed.

The drawback in drive shafts of this type along the length of the machine is also the poor exchangeability of yarn-transporting components. The changing of an overfeed roller is, for example, relatively complex. It has therefore already been proposed in the past to dispense with drive rollers along the length of the machine, at least for the overfeed rollers, and instead to also drive the overfeed rollers by means of the drive shafts present in any case for the friction rollers.

German Patent Publication DE 10 2005 050 074 A1 describes a two-for-one twisting or cabling machine, in which the overfeed rollers of the numerous workstations are in each case mounted individually on special support elements, which make it possible to pivot the overfeed rollers between an operating position and a service position. The overfeed rollers are also in each case connected by a continuous traction means to one of the two friction shafts along the length of the machine, the continuous traction means, on the one hand, comprising a drive element arranged on one of the friction shafts along the length of the machine and, on the other hand, being drawn onto an output means non-rotatably connected to the overfeed roller. In practice, the arrangement, known per se, of continuous traction means, has proven not to be particularly advantageous, however. In other words, in these two-for-one twisting or cabling machines, an exchange of the continuous traction means "caught" by a friction shaft along the length of the machine and generally configured as a round belt is always, when necessary, relatively difficult and time-consuming, which, as at least one machine side of the two-for-one twisting or cabling machine generally has to be shut down during the change process, has a negative effect on the efficiency of the textile machine.

Two-for-one twisting and cabling machines are also known from German Patent Publication DE 10 2006 061 289 A1, in which the overfeed rollers are in each case connected by a magnetic gearing to a drive shaft, preferably to the friction shaft of one of the two textile machines. Magnetic gearings of this type are relatively insensitive to soiling and have the advantage of great operating reliability.

In contrast to positive torque transmission devices, for example, the exceeding of a limit torque upon the occurrence of an unforeseen operating condition immediately leads to the standstill of the associated overfeed roller in magnetic gearings of this type.

A serious drawback of this magnetic gearing, which is advantageous per se, is, however, its relatively complex construction, which leads to magnetic gearing of this type, in particular in relation to the above-described continuous traction means, being very expensive.

SUMMARY OF THE INVENTION

Proceeding from the aforementioned prior art, the invention is based on the object of developing a multiple station textile machine, which does not have the above-described drawbacks, but nevertheless has a reliable and economical drive for its numerous yarn processing devices, which are arranged in each case in the region of the workstations.

This object is achieved according to the invention by a textile machine with a plurality of workstations each equipped with at least one yarn processing device, and at least one drive shaft extending in the longitudinal direction of the textile machine over a plurality of workstations, each yarn processing device being connected to the drive shaft by a continuous traction means, and the drive shaft including a large number of drive devices each guiding and entraining a respective continuous traction means. According to the present invention each drive device of the drive shaft has two deflection and guide grooves arranged coaxially with respect to the drive shaft, one of the deflection and guide grooves being a component of a wheel freely rotatably mounted about the drive shaft. An output means is connected to each respective yarn processing device, each output means having front and rear guide grooves, the front guide groove being positioned at a freely accessible end of the output means and the rear guide groove being positioned in the region of the respectively associated yarn processing device. Each continuous traction means (19) has opposite end loops joined endlessly by two connecting strands. One end loop is engaged in the rear guide groove (26B) of the output means (22) which is connected to the respective yarn processing device (41). The two strands extend from the one end loop and are respectively engaged in the deflection and guide grooves (30, 34) of the drive shaft (35). Between the drive shaft (35) and the other end loop, the two strands are twisted lengthwise relative to one another by a 180 degree rotation thereof, and the other end loop is engaged in the front guide groove (26A) of the output means (22). In this manner, the end loops travel in the same direction as one another in the grooves (26A, 26B).

Various advantageous embodiments of the invention are contemplated.

The configuration according to the invention has the advantage, in particular, that the continuous traction means can easily be exchanged without problems if necessary. In other words, the drive devices of the drive shaft in each case have two coaxially arranged deflection and guide grooves, one of the deflection and guide grooves being a component of a loose wheel, i.e., as such term is used herein, a wheel that is freely rotatably mounted about the drive shaft. When drawing up the continuous traction means, the latter can firstly be inserted by means of a loop into the rear guide groove of an output means connected to an overhung yarn processing device and then drawn around the associated drive device fixed to the drive shaft in such a way that two strands of the continuous traction means located next to one another encompass the two deflection and guide grooves of the drive device arranged coaxially with respect to the drive shaft. The remaining loop of the continuous traction means can then be inserted with a rotation through 180 degrees into the guide groove positioned at the freely accessible end of the drive means of the yarn processing device.

It is also provided in an advantageous embodiment that the deflection and guide grooves of the drive device, in which the two strands of the continuous traction means are guided, are arranged adjacently and in parallel. The milling and bending forces acting on the continuous traction means during operation can be minimized by an arrangement of this type of the deflection and guide grooves, which has a very positive effect on the service life of the respective continuous traction means.

According to another aspect of the invention, it is furthermore provided that drive device preferably has a rotation body, which is non-rotatably arranged with respect to the drive shaft, with a deflection and guide groove for the strand of the continuous traction means to be driven and a rotation body, which is rotatably mounted with respect to the drive shaft, with a deflection and guide groove for the strand of the continuous traction means running counter to the drive direction. In other words, the deflection and guide grooves are arranged and configured in the rotation body of the drive device in such a way that proper running of the continuous traction means is always ensured.

It is provided in an advantageous embodiment that the drive device is configured as a belt pulley element, with a base body non-rotatably fixed to the drive shaft and a loose wheel freely rotatably mounted on the base body. In this case, the base body is equipped with a deflection and guide groove for the strand of the continuous traction means to be driven, while the loose wheel has a deflection and guide groove for the strand of the continuous traction means running in the opposite direction. A configuration of this type of the drive device does not only ensure reliable driving of the yarn processing devices arranged in the region of the workstations of the textile machine, but overall a long service life of the drive device.

According to another feature of the invention, it is provided in an advantageous embodiment, that one drive shaft is arranged for each machine side of the textile machine and is equipped with a large number of friction rollers driving the take-up bobbins, the drive devices being formed by deflection and guide grooves integrated into the friction rollers for the strand of the continuous traction means to be driven and adjacently arranged belt pulley devices. In other words, the belt pulley devices in each case have a loose wheel with a deflection and guide groove for the strand of the continuous traction means running in the opposite direction. A design of this type does not only allow a very compact configuration of a workstation, so that it is easily ensured that the spindle spacing of the textile machine can be minimized, but it also keeps the structural outlay for the drive devices within limits.

It is also provided in an advantageous embodiment that the loose wheel is freely rotatably connected to the base body by a bearing.

A roller bearing is the optimal solution for the provided purpose of use, as roller bearings of this type are not only proven, economical mass production components, which also manage higher rotational speeds without problems, but roller bearings of this type are also components, which are distinguished by a long service life.

In an alternative embodiment, a sliding bearing may also be used, however, as a bearing. Sliding bearings of this type are also proven, low-maintenance machine parts.

It is provided in a further embodiment that a central nut shaft along the length of the machine, preferably driven at the end of the machine, is used as the drive shaft for the yarn processing devices. Fixed to this drive shaft in the region of the workstations is, in each case, at least one drive device, which is in turn connected by a continuous traction means and an associated output means to a yarn processing device, the continuous traction means being alternately guided to both machine sides. The yarn processing devices of the two machine sides of a textile machine can be driven simultaneously by a central nut shaft of this type.

When using a nut shaft of this type it is not only possible without problems to adjust the rotational direction of the yarn processing devices of the two textile machine sides by different crossings of the continuous traction means, but also a central adjustment of the working speed of the connected yarn processing devices is easily possible by means of the rotational speed of the central nut shaft. If these yarn processing devices, as, for example, known from two-for-one twisting or cabling machines, are configured as overfeed rollers, a central adjustment of the so-called overfeed factor of the numerous overfeed rollers can easily be realized.

It is furthermore provided in an advantageous embodiment that round belts are used as continuous traction means, the length of the round belt in the each case being more than four times the spacing provided between the center axis of the drive device and the center axis of the output means.

Round belts of this type are continuous traction means that have proven successful for a long time in mechanical engineering and are economical to obtain commercially as they are standardized mass produced parts. Moreover, round belts of this type, in particular if the continuous traction means has to be installed in the crossed state, have repeatedly proven to be successful in practice as a reliable drive means. In other words, round belts of this type are reliable and economical connection elements.

The yarn processing devices repeatedly described above, like the textile machines, may be configured very differently.

In conjunction with two-for-one twisting or cabling machines, the yarn processing devices, for example, may be configured as overfeed rollers, which preferably, as known, are overhung. In conjunction with such overhung over feed rollers, the output means, which are looped by the continuous traction means, are in each case mounted on easily accessible bearing shafts in such a way that, if necessary, both the continuous traction means and the output means can easily be exchanged. In other words, in this type of bearing arrangement, during a necessary intervention, all the rotating parts in the region of the overfeed roller can temporarily be shut down without problems, the handling at the overfeed roller also being simplified and the risk of injury therefore being minimized by the relatively large free space available.

However, instead of overfeed rollers, other yarn processing devices may also be used as yarn processing devices, which are driven by a continuous traction means installed according to the invention.

It is also certainly possible, for example to drive godets by a drive shaft of a textile machine, which is equipped with drive devices for guiding and entraining continuous traction means and has corresponding continuous traction means. The godets, which are preferably also overhung, are each provided here on their bearing axis with an output means.

A further use possibility for a drive device according to the invention also lies, for example, in the drive of waxing devices, as are known from various textile machines. Waxing devices of this type may also be advantageously driven by means of drive devices which are arranged on a drive shaft along the length of the machine and which are encompassed by continuous traction means installed according to the invention and act on output means connected to the waxing devices.

Independently of the respective type of yarn processing device, the configuration and arrangement according to the invention of drive devices arranged on a drive shaft along the length of the machine, in conjunction with corresponding output means in the region of the yarn processing devices and continuous traction means applied according to the invention, always allow a reliable and economical drive of yarn processing devices of this type.

BRIEF DESCRIPTION OF THE DRAWINGS

Further details of the invention will be described below with the aid of embodiments shown in the drawings, in which.

DETAILED DESCRIPTION OF THE PREFERRED EMBODIMENTS

Figure 1:
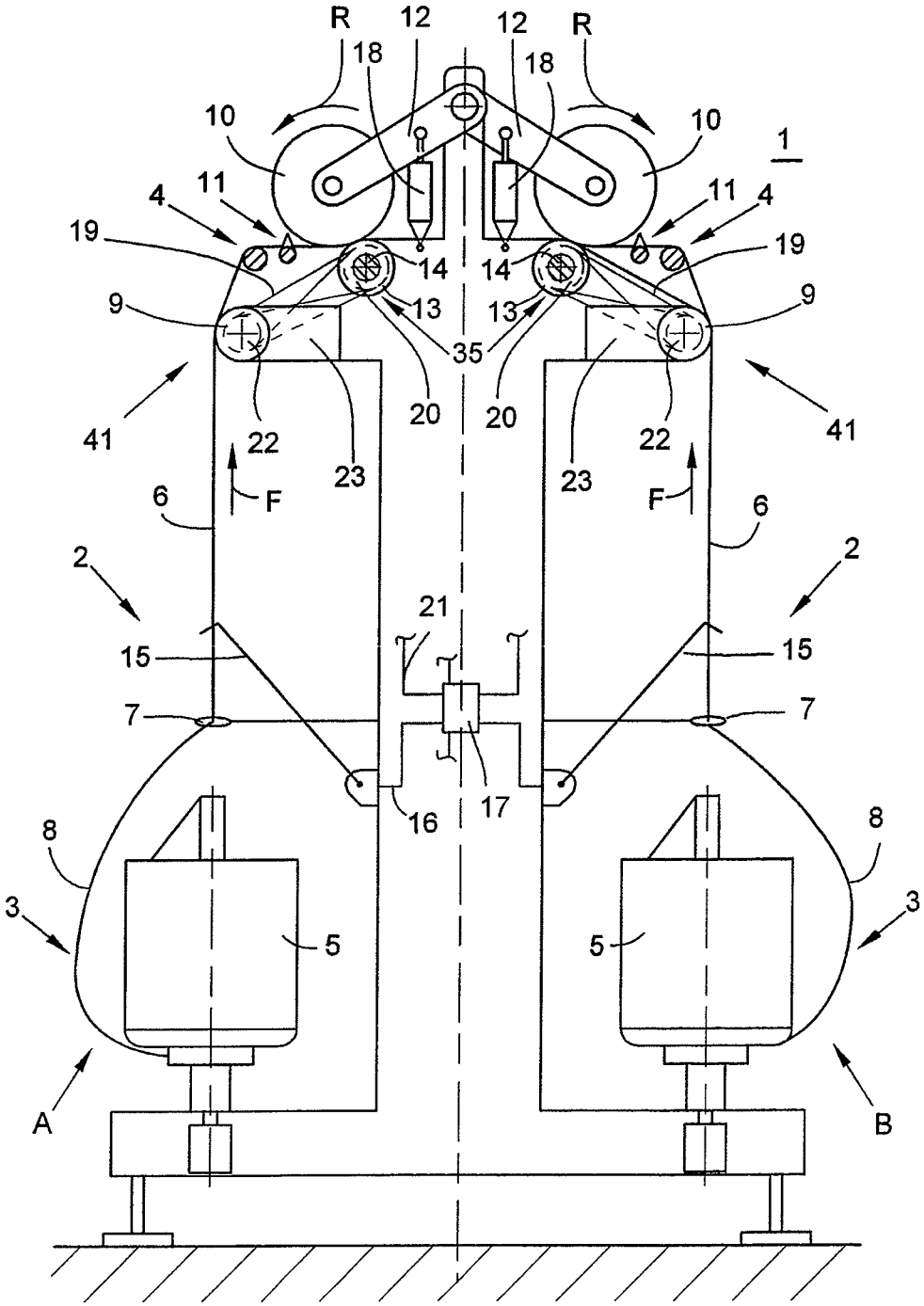
FIG. 1 schematically shows a side view of a multiple station textile machine, in the present embodiment a two-for-one twisting or cabling machine, with identical workstations arranged next to one another in the region of the longitudinal sides of the machine, yarn processing devices, in the present case overfeed rollers, arranged in the region of the workstations, in each case being connected in the configuration according to the invention by a continuous traction means to a drive shaft, in the embodiment to one of the friction shafts, of the multiple station textile machine.

FIG. 1 schematically shows a side view of a multiple station textile machine, a two-for-one one twisting or cabling machine 1 in the embodiment. As known, textile machines of this type have a large number of workstations 2, which are arranged next to one another on both sides of the longitudinal axis of the machine. The workstations 2 of two-for-one twisting or cabling machines 1 of this type are in each case inter alia equipped with a two-for-one twisting device 3 and a winding mechanism 4. In the embodiment shown in FIG. 1, a yarn 6 drawn from a two-for-one twisting spindle 5 runs via a yarn guide 7, which limits a yarn balloon 8 being produced in the region of the twisting device 3 with respect to its height during the twisting operation, to the winding mechanism 4, where the yarn 6 is wound to form a cross-wound bobbin 10.

The winding device 4, as conventional, has a creel 12 to rotatably hold the cross-wound bobbin 10, the creel 12 being liftable, if necessary, by means of a pneumatic cylinder 18.

Furthermore, the winding mechanism 4 has a friction roller 13 fixed on a continuous friction shaft 14 to rotate the cross-wound bobbin 10 in the rotational direction R and a yarn traversing device 11 to traverse the yarn 6 that is traveling to and being wound onto the bobbin.

A yarn processing device 41, an overfeed roller 9 in the embodiment, is arranged in the yarn running direction F before the yarn traversing device 11 and is connected by a continuous traction means 19, drawn up according to the invention, to a drive shaft along the length of the machine, in the embodiment of FIG. 1 to a friction shaft 14 of the relevant machine side of the multiple station textile machine 1.

Arranged between the yarn guide 7 and the overfeed roller 9 is furthermore a yarn sensing device 15, which monitors the proper running of the yarn 6 during the twisting process. The yarn sensing device 15, which is connected by a signal line 16 to the control device 17, detects yarn breaks occurring during the twisting operation and signals this immediately, in each case, to the control device 17, which thereupon initiates a loading of the associated pneumatic cylinder 18 with pressure by means of the control line 21. In other words, when a yarn break occurs, the creel 12 is pivoted up and the cross-wound bobbin 10 is thereby lifted from the revolving friction roller 13. After the elimination of the yarn break, the creel 12 is lowered again, so the cross-wound bobbin 10 rests on the friction roller 13 again and can again be rotated thereby by frictional engagement in the direction R.

As schematically shown in FIG. 1, drive devices 20, which are in each case connected by a specially arranged continuous traction means 19 and an associated output means 22 to one of the yarn processing devices 41, overfeed rollers 9 in the embodiment, are fixed on the friction shafts 14 along the length of the machine and acting as drive shafts. The overfeed rollers 9 in two-for-one twisting or cabling machines, as is known, serve to reduce the yarn tension of the yarn 6 to be wound on, which, after cabling or twisting, has a yarn tension, the so-called balloon tension, which is above the yarn tension reasonable to build up a cross-wound bobbin 10. To reduce this excess yarn tension, the overfeed roller 9, which is at least partially looped by the yarn 6, is driven at a peripheral speed, which is greater than the yarn speed of the yarn 6 running on to the cross-wound bobbin 10. This means that the balloon tension is reduced because of the peripheral speed of the overfeed roller 9, which is higher in relation to the yarn speed, and the degree of looping of the yarn 6 around the overfeed roller 9, until a yarn tension reasonable for the build-up of a proper cross-wound bobbin 10 is present. As can also be seen, in particular from FIG. 2, the overfeed roller 9 is preferably in each case arranged axially parallel to the friction shaft 14 on a carrier 23.

To simplify the assembly and disassembly of the overfeed roller 9, an overhung arrangement of the overfeed roller 9 is provided in an advantageous embodiment. An output means 22 is non-rotatably installed on the bearing shaft 25 of the overhung overfeed roller 9, which output means, as can be seen from FIG. 6, has two adjacently arranged deflection and guide grooves 26A, 26B for two strands of the continuous traction means 19 and a suitable shaft/hub connection, for example a threaded bore 27, for a clamping screw or the like, to fix the output means 22 to the bearing shaft 25.

Figure 5A:
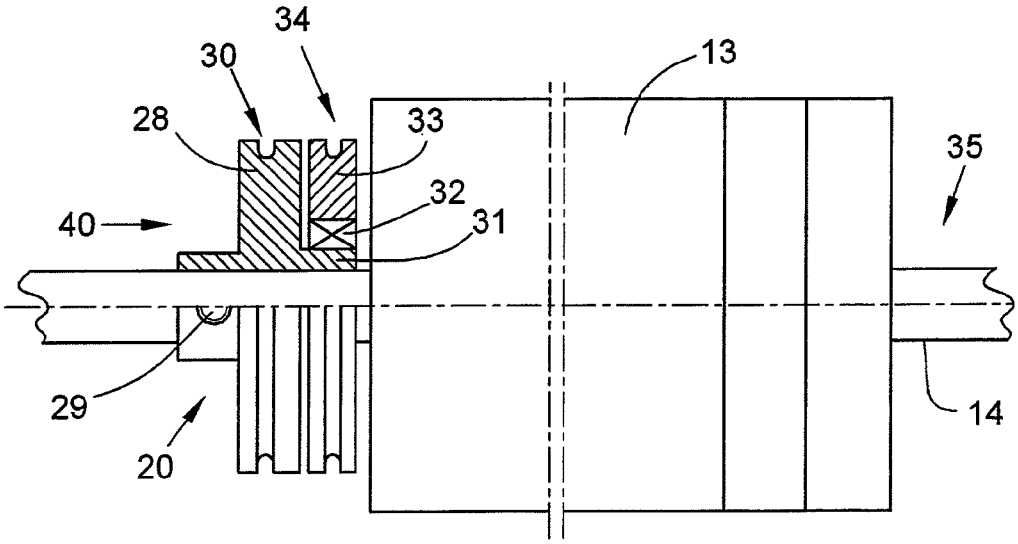
FIG. 5A shows a first embodiment of a drive device installed in the region of a friction shaft.
Figure 5B:
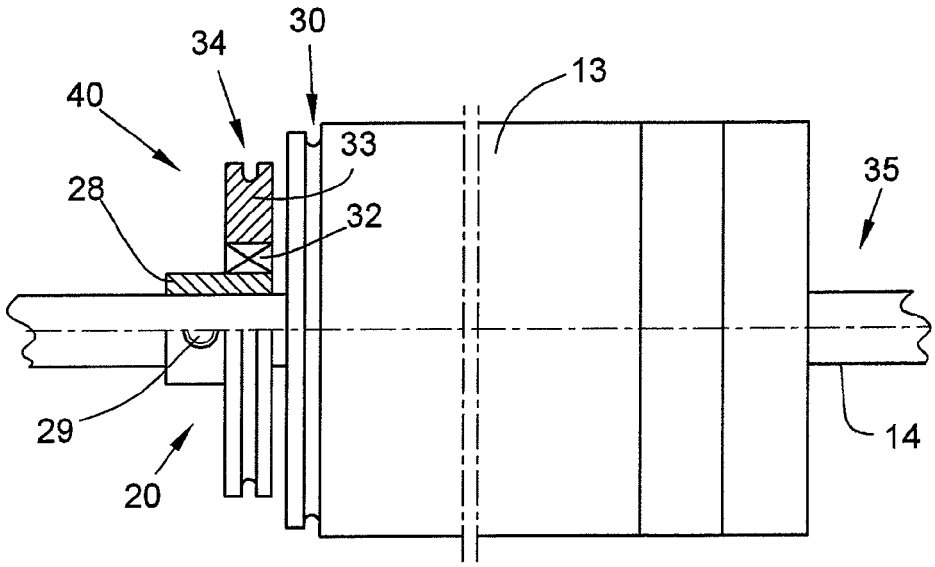
FIG. 5B shows a second embodiment of a drive device installed in the region of a friction shaft.

The associated drive devices 20 which, as shown in FIGS. 5A, 5B, are at least partially configured as a belt pulley device 40, may also have various embodiments. All the embodiments have a base body 28, which can be fixed by means of a threaded bore 29 and a clamping screw or the like on the friction shaft 14 in a non-rotatable manner.

As shown in FIG. 5A, the base body 28, in a first embodiment, is equipped with a deflection and guide groove 30 for the strand to be driven of the continuous traction means 19 and with a bearing attachment 31 for a bearing 32, which is preferably configured as a roller bearing or as a sliding bearing. In the present embodiment, fixed on the outer ring of a roller bearing 32, is a so-called loose wheel 33, which has a deflection and guide groove 34 for a second strand, which runs counter to the drive direction of the yarn processing device 41, of the same continuous traction means 19.

In the second embodiment of a drive device 20 shown in FIG. 5B, the deflection and guide groove 30 for the strand to be driven of the continuous traction means 19 is integrated into the friction roller 13. Fixed closely next to the friction roller 13 on the friction shaft 14 in a non-rotatable manner is a base body 28, which has a bearing 32, for example a roller bearing or a sliding bearing.

As known from the embodiment according to FIG. 5A, a so-called loose wheel 33, which has a deflection and guide groove 34 for the second strand of the continuous traction means 19 running in the opposite direction, is fastened to the outer ring of the roller bearing 32.

Figure 2:
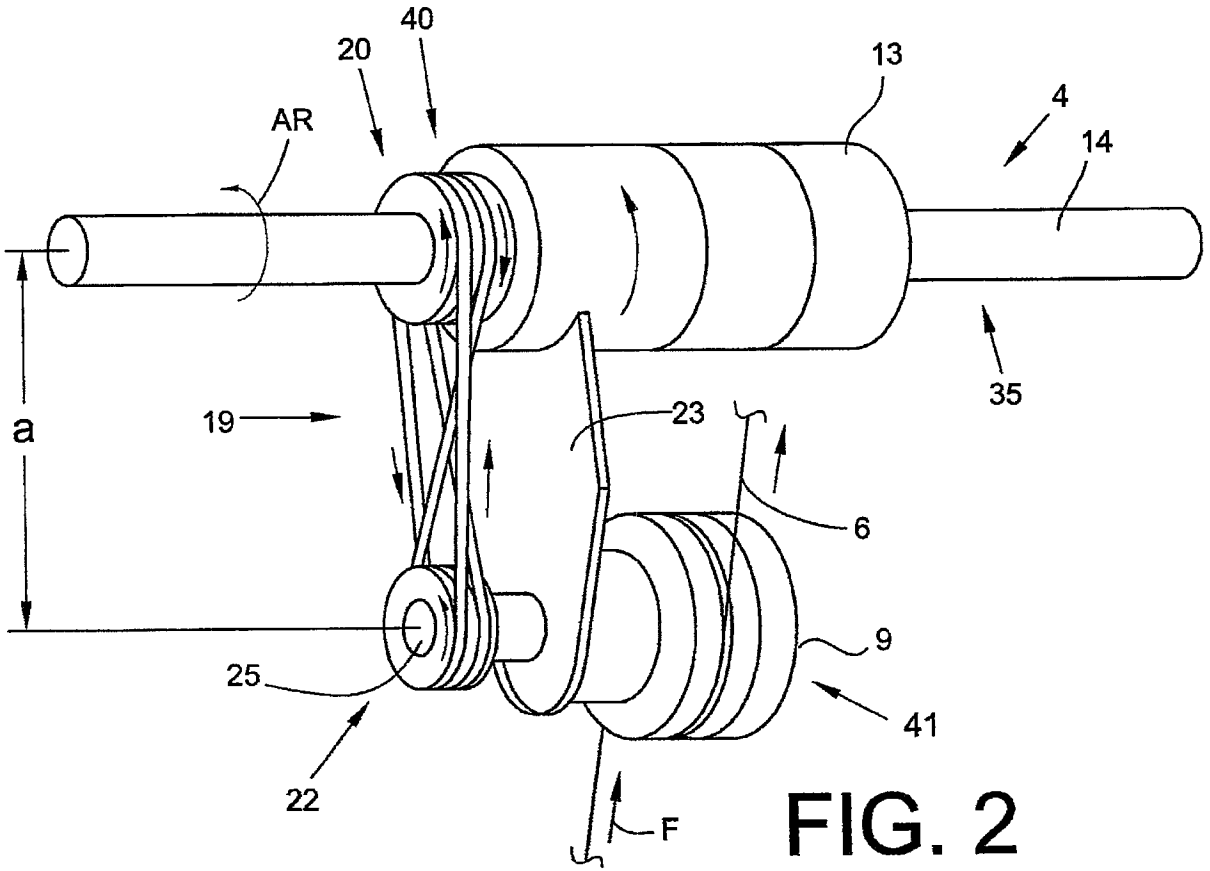
FIG. 2 shows, in detail, a first embodiment of the attachment according to the invention, indicated schematically in FIG. 1, of an overfeed roller to one of the friction shafts of a two-for one twisting or cabling machine.

As shown, for example in FIG. 2, the continuous traction means 19 in the arrangement according to the invention, after being drawn onto the drive device 20 and the output means 22, is in each case located with its two strands in the deflection and guide grooves of the presently described components.

Figure 7:
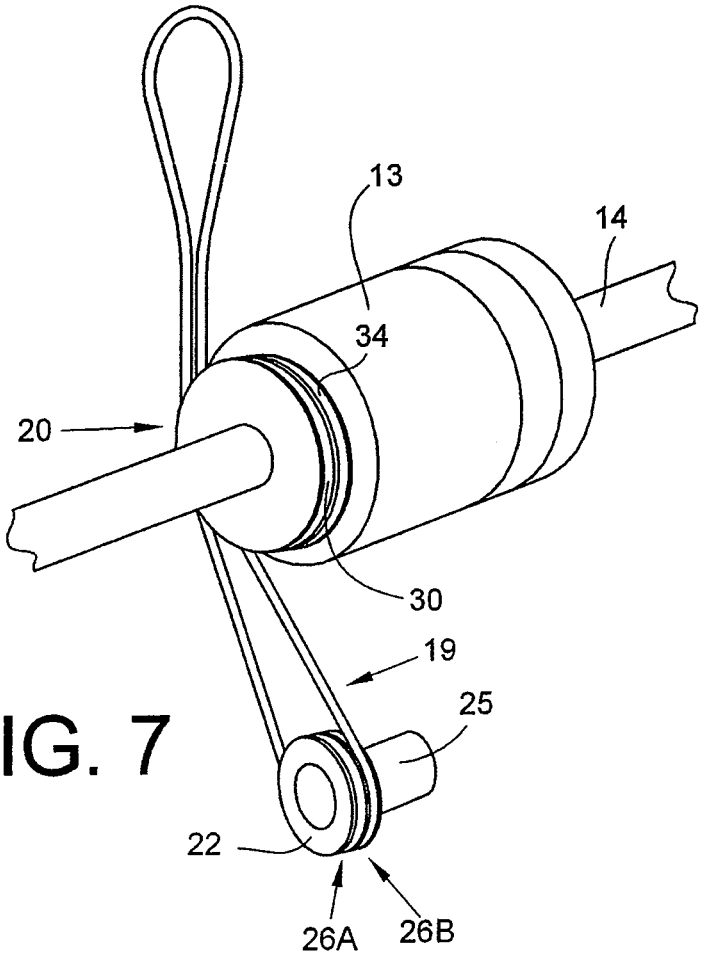
FIG. 7 shows a continuous traction means while being placed on a drive device or shortly before being drawn onto an associated output means.

During assembly of the continuous traction means 19, the continuous traction means 19, as shown in FIG. 7, is firstly placed in the rear receiving groove 26B of the output means 22, in relation to the carrier 23, not shown in FIG. 7. The continuous traction means 19 is then drawn around the drive device 20 fixed to the friction shaft 14 along the length of the machine in such a way that two adjacent strands of the continuous traction means 19 encompass the drive device 20, which, for example, has the embodiment shown in FIG. 5A. In other words, the rear strand of the continuous traction means 19 in relation to the friction roller 13 is placed in the deflection and guide groove 34 of a loose wheel 33 rotatably mounted on the base body 28 of the drive element 20, while the front strand of the continuous traction means 19 is positioned in the belt receiving groove 30 of the base body 28 of the drive device 20. The two strands of the continuous traction means 19 are then twisted lengthwise relative to one another about their common longitudinal axis by a 180 degree rotation of the strands between the drive shaft 35 and the other end loop and the other end loop is placed in this state in the front receiving groove 26A of the output means 22. In this manner, the end loops travel in the same direction as one another in the grooves 26A, 26B.

Figure 3:
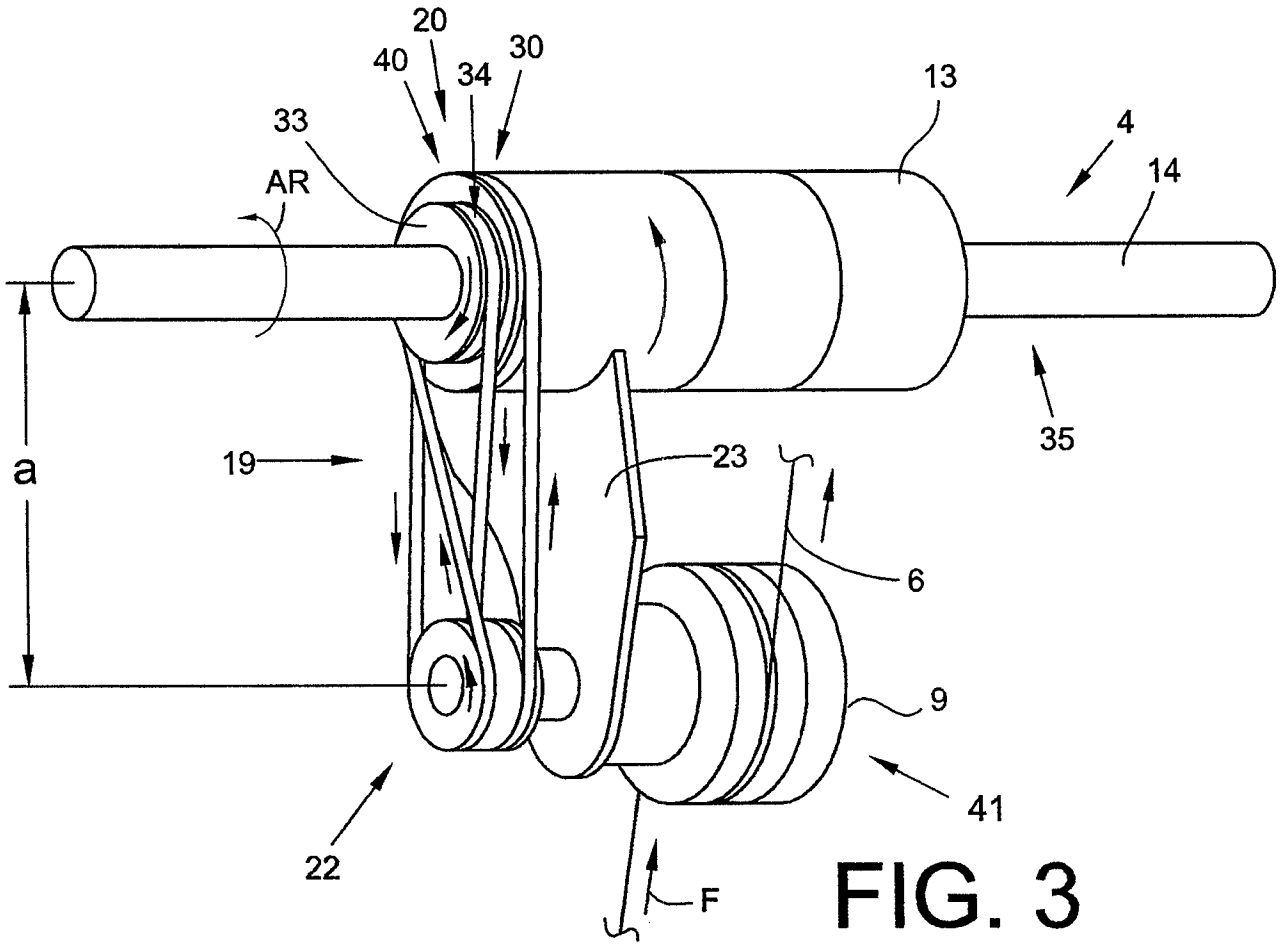
FIG. 3 shows, in detail, a second embodiment of an attachment according to the invention of an overfeed roller to a friction shaft of a two-for one twisting or cabling machine.

In the embodiment shown in FIGS. 2 and 5A, the drive device 20 is in each case completely configured as a separate belt pulley device 40, which is fastened at a spacing next to the friction roller 13 on the friction shaft 14. In other words, the belt pulley device 40 has a base body 28 with a deflection and guide groove 30, a bearing 32 and a loose wheel 33 with a deflection and guide groove 34 and is non-rotatably fixed with its base body 28 by a shaft/hub connection, for example, on a friction shaft 14 acting as a drive shaft 35. In an alternative embodiment, shown in FIGS. 3 and 5B, the drive device 20 is partially integrated into the friction roller 13. In other words, the friction roller 13 has a deflection and guide groove 30, into which the strand of the continuous traction means 19 to be driven in the drive direction AR is placed. A belt pulley device 40 is additionally arranged directly next to the friction roller 13 on the friction shaft 14, on the base body 28 of which belt pulley device a loose wheel 33 is freely rotatably mounted by a roller bearing 32, in the deflection and guide groove 34 of which the second strand of the continuous traction means 19 is mounted in such a way that it can revolve counter to the drive direction AR of the yarn processing device 41.

Figure 4:
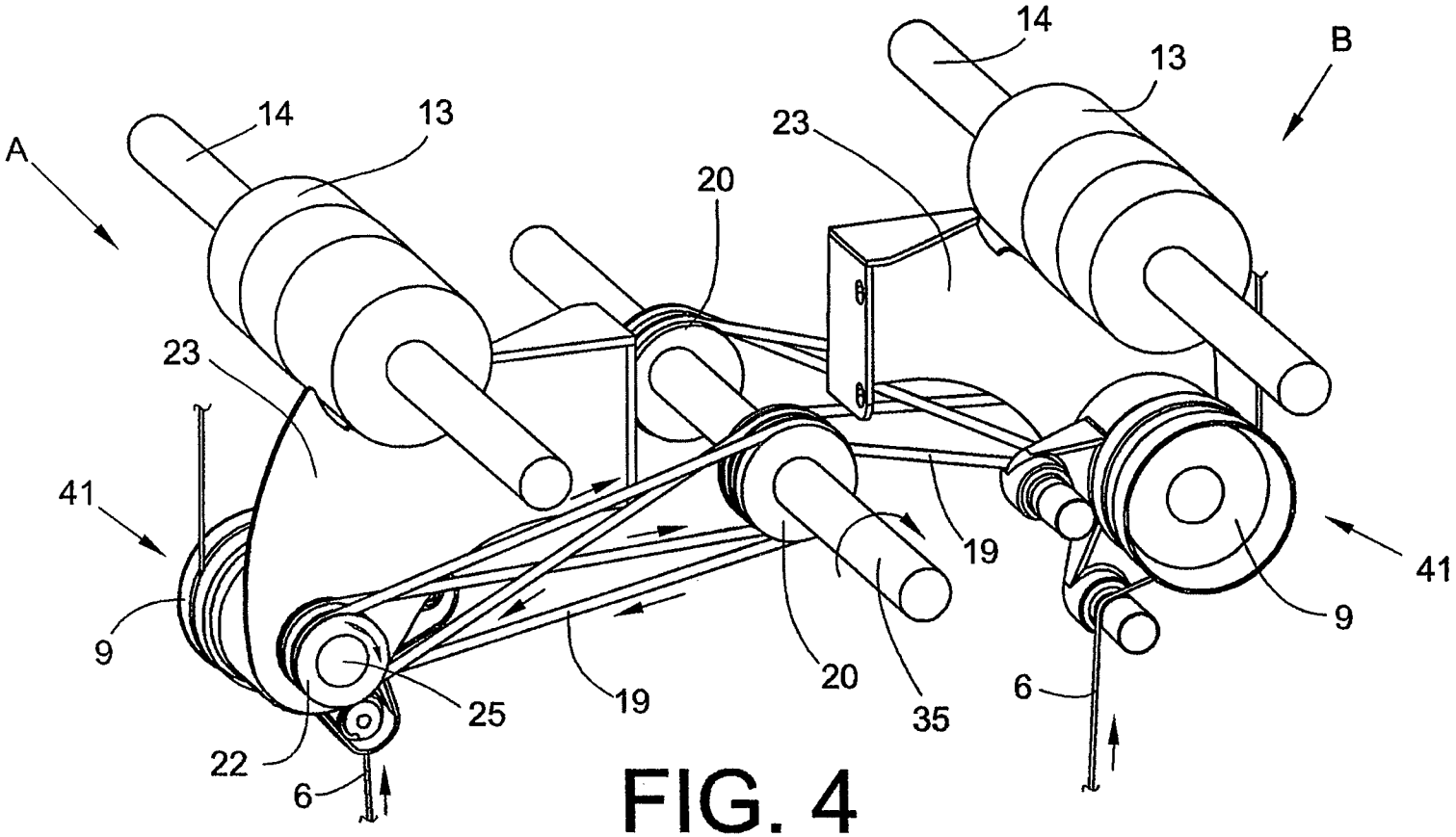
FIG. 4 shows, in detail, a further embodiment of the attachment according to the invention of overfeed rollers to a drive shaft, the drive shaft being configured as a central nut shaft in the present embodiment.

FIG. 4 shows an embodiment, in which a central nut shaft along the length of the machine is used as the drive shaft 35 instead of the friction shafts 14 arranged on the machine sides A and B of the multiple station textile machine 1. As already stated above in conjunction with the friction shafts 14 configured as drive shafts 35, a large number of drive devices 20, which are in each case connected by a continuous traction means 19 to an output means 22 of a yarn processing device 41, also an overfeed roller 9 in the present embodiment, are also fixed on this central drive shaft 35. In this arrangement, the drive devices 20 or the output means 22 preferably have the embodiments shown in FIG. 5A or FIG. 6. The embodiment shown in FIG. 4, in particular, has the advantage that in an arrangement of this type, the rotational direction of the yarn processing devices 41 can easily be properly adjusted by a corresponding crossing of the continuous traction means 19.

Figure 6:
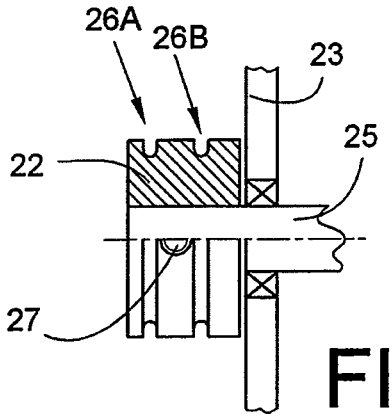
FIG. 6 shows an output means installed in the region of a bearing shaft of a yarn processing device, for example an overfeed roller.

FIG. 6 shows, partially in section, an output means 22, the base body 28 of which can be fixed by means of a shaft/hub connection, for example by means of a clamping screw (not shown), which corresponds with the threaded bore 27, on the bearing shaft 25 of a yarn processing device (not shown). The base body 28 has two deflection and guide grooves 26A and 26B arranged in parallel next to one another for two strands, which are loaded in the drive direction, of a continuous traction means 19.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile machine (1) with a plurality of workstations (2) each equipped with at least one yarn processing device (41), and at least one drive shaft (35) extending in the longitudinal direction of the textile machine over a plurality of workstations, each yarn processing device (41) being connected to the drive shaft by a continuous traction means (19), the drive shaft including a large number of drive devices (20), each drive device guiding and entraining a respective continuous traction means (19), characterized in that each drive device (20) of the drive shaft (35) has two deflection and guide grooves (30, 34) arranged coaxially with respect to the drive shaft (35), one of the deflection and guide grooves (30, 34) being a component of a wheel (33) freely rotatably mounted about the drive shaft, an output means (22) connected to each respective yarn processing device (41), each output means having front and rear guide grooves (26A, 26B), the front guide groove (26A) being positioned at a freely accessible end of the output means (22) and the rear guide groove (26B) being positioned in the region of the respectively associated yarn processing device (41), and each continuous traction means (19) having opposite end loops joined endlessly by two connecting strands, one end loop engaged in the rear guide groove (26B) of the output means (22) which is connected to the respective yarn processing device (41), the two strands extending from the one end loop being respectively engaged in the deflection and guide grooves (30, 34) of the drive shaft (35), the two strands being twisted lengthwise relative to one another by a 180 degree rotation thereof between the drive shaft (35) and the other end loop, and the other end loop being engaged in the front guide groove (26A) of the output means (22), whereby the end loops travel in the same direction as one another in the grooves (26A, 26B).

2. A textile machine according to claim 1, characterized in that the deflection and guide grooves (30, 34) of the drive device (20), in which two strands of the continuous traction means (19) are guided, are arranged adjacently and in parallel.

3. A textile machine according to claim 1 or 2, characterized in that the drive device (20) has a rotation body, which is non-rotatably arranged with respect to the drive shaft (35), with a deflection and guide groove (30) for a strand of the continuous traction means (19) to be driven, and a rotation body, which is freely rotatably mounted with respect to the drive shaft (35), with a deflection and guide groove (34) for a strand, which runs counter to the drive direction of the strand to be driven, of the continuous traction means (19).

4. A textile machine according to claim 3, characterized in that the drive device (20) is configured as a belt pulley element (40), with a base body (28), which is fixed to the drive shaft (35), and a loose wheel (33), which is freely rotatably mounted on the base body (28), the base body (28) having the deflection and guide groove (30) for the strand to be driven of the continuous traction means (19) and the loose wheel (33) having the deflection and guide groove (34) for the strand running in the opposite direction of the continuous traction means (19).

5. A textile machine according to claim 3, characterized in that a drive shaft (35) is provided for each machine side (A, B), which has friction rollers (13) driving take-up bobbins (10) and the drive devices (20) are formed by integrated deflection and guide grooves (30) for the strand to be driven of the respective continuous traction means (19) and have an adjacently arranged belt pulley device (40) with a loose wheel (33), into which the deflection and guide groove (34) for the strand running in the opposite direction of the continuous traction means (19) is worked.

6. A textile machine according to claim 4, characterized in that the loose wheel (33) is in each case freely rotatably connected by a bearing (32) to the base body (28) of the drive device (20).

7. A textile machine according to claim 6, characterized in that the bearing (32) is configured as a roller bearing.

8. A textile machine according to claim 6, characterized in that the bearing (32) is configured as a sliding bearing.

9. A textile machine according to claim 1, characterized in that the drive shaft (35) of the textile machine (1) is configured as a central nut shaft along the length of the machine, to which nut shaft, in the region of the workstations (2), at least one respective drive device (20) is fixed, which is in turn connected by a continuous traction means (19) and an associated output means (22) to a yarn processing device (41), the continuous traction means (19) being alternately guided to the two machine sides (A, B).

10. A textile machine according to claim 1, characterized in that the continuous traction means (19) are configured as round belts, the length of which is in each case more than four times the spacing (a) provided between the centre axis of the drive device (20) and the centre axis of the output means (22).

11. A textile machine according to claim 1, characterized in that the yarn processing devices (41), which are driven by continuous traction means (19), are overhung overfeed rollers (9) of a two-for-one twisting machine or cabling machine.

12. A textile machine according to claim 1, characterized in that the yarn processing devices (41), which are driven by continuous traction means (19), are godets.

13. A textile machine according to claim 1, characterized in that the yarn processing devices (41), which are driven by continuous traction means (19), are waxing devices.

14. A textile machine according to claim 9, characterized in that the rotational direction of the yarn processing devices (41) arranged, in each case, on both sides (A, B) of the textile machine (1) can be adjusted in a defined manner by a corresponding crossing of at least one strand of the continuous traction means (19).

15. A textile machine according to claim 9 or 11, characterized in that a central adjustment of the so-called overfeed factor of the numerous overfeed rollers (9) connected to the nut shaft can be realized by the rotational speed of the drive shaft (35) configured as a central nut shaft.

* * * * *